US006373959B1

(12) United States Patent
Masuda et al.

(10) Patent No.: US 6,373,959 B1
(45) Date of Patent: Apr. 16, 2002

(54) ELECTROACOUSTIC TRANSDUCER

(75) Inventors: Mitsuhiro Masuda; Takahiro Sone, both of Sizuoka (JP)

(73) Assignee: Star Micronics Co., Ltd., Shizouka (JP)

( * ) Notice: Subject to any disclaimer, the term of this patent is extended or adjusted under 35 U.S.C. 154(b) by 0 days.

(21) Appl. No.: 09/927,261

(22) Filed: Aug. 13, 2001

(30) Foreign Application Priority Data

Aug. 11, 2000 (JP) ..... 2000-244908

(51) Int. Cl.[7] ..... H04R 25/00
(52) U.S. Cl. ..... 381/417; 396/345
(58) Field of Search ..... 381/345, 353, 381/354, 396, 398, 409, 410, 412, 417, FOR 160, 431

(56) References Cited

U.S. PATENT DOCUMENTS 3,542,974 A * 11/1970 Blastic et al. ..... 381/417
5,432,758 A * 7/1995 Sone ..... 381/398

* cited by examiner

*Primary Examiner*—Huyen Le
(74) *Attorney, Agent, or Firm*—Sughrue Mion, PLLC

(57) ABSTRACT

An electroacoustic transducer 1 is provided with a diaphragm 20 which is made of a magnetic material, and to which a magnetic piece 21 is fixed; a magnetic core 22 which is placed in proximity to the diaphragm 20; a coil 23 which supplies an oscillating magnetic field to the magnetic core 22; a housing 10 which accommodates the diaphragm 20, the magnetic core 22, and the coil 23, and which has a sound release opening 11 in a top plate opposed to the diaphragm 20, the sound release opening being larger than the magnetic piece 21. A beam portion 12 is formed integrally with the housing 10 which extends from a peripheral portion of the sound release opening 11 to another peripheral portion passing above the magnetic piece 21. A gap Ga between the diaphragm 20 and the magnetic core 22, and a gap Gb between the magnetic piece 21 and the beam portion 12 satisfy relationships of $Ga \leqq Gb \leqq 5Ga$.

4 Claims, 4 Drawing Sheets

CONVENTIONAL ART

ELECTROACOUSTIC TRANSDUCER

BACKGROUND OF THE INVENTION

1. Field of the Invention

The present invention relates to an electroacoustic transducer which generates a sound by means of electromagnetic acoustic conversion.

2. Description of the Related Art

FIG. 4 is a perspective view showing an example of an electroacoustic transducer of the conventional art. The electroacoustic transducer 90 comprises a diaphragm 93 made of a magnetic material; a magnetic piece 94 fixed to the center of the diaphragm 93; an electromagnetic coil (not shown) supplying an oscillating magnetic field to the diaphragm 93; a housing member 91 accommodating the diaphragm 93 and the electromagnetic coil; etc. Since a sound release opening 91*b* having a diameter larger than the magnetic piece 94 is formed in a top plate 91*a* of the housing member 91 to oppose to the diaphragm 93, such a transducer is usually called an open-type electroacoustic transducer.

When an electric oscillating signal is supplied to the electromagnetic coil, an oscillating magnetic field generated by the electromagnetic coil oscillates the diaphragm 93 to generate a sound. The sound is released to the outside through the sound release opening 91*b*.

In the open-type electroacoustic transducer 90, ideal acoustic performance is attained by reducing sound interference. Therefore, conventionally nothing is placed in front of the diaphragm 93 to increase the area of the sound release opening 91*b*.

When an operator or a working robot erroneously contacts with the diaphragm 93 during a process of packing or transportation of the transducer 90 or mounting the transducer on a circuit board, the diaphragm 93 is deformed or becomes dirty, and desired performance cannot be obtained. In order to enhance the oscillation efficiency, the diaphragm 93 is formed to be very thin, and hence a component failure is caused even by a light contact.

In order to miniaturize and lighten the transducer 90, moreover, the housing member 91 also is formed to be very thin. When the sound release opening 91*b* is large, therefore, the strength of the housing member itself is decreased so that the housing member 91 is deformed into an oval shape, simply by, for example, pressing the outer periphery by fingers. This causes a dimensional failure in a subsequent assembling step.

SUMMARY OF THE INVENTION

It is an object of the invention to provide an electroacoustic transducer in which contact with a diaphragm and deformation of a housing member can be surely prevented from occurring, and which can be miniaturized and produce a high sound pressure.

According to the invention, there is provided an electroacoustic transducer comprising:

- a diaphragm made of a magnetic material having a magnetic piece fixed onto the center there of;
- a magnetic core disposed with a gap Ga from the diaphragm;
- an electromagnetic coil for supplying an oscillating magnetic field to the magnetic core; and
- a housing member accommodating the diaphragm, the magnetic core, and the electromagnetic coil, and defining a sound release opening in a top surface thereof opposed to the diaphragm, the sound release opening being larger than the magnetic piece,
- wherein a beam portion is integrally formed with the housing member, and extends from a peripheral portion of the sound release opening to another peripheral portion thereof;
- the beam portion passes above the magnetic piece with a gap Gb being defined between the magnetic piece and the beam portion; and
- the gap Ga and the gap Gb satisfy a relationship of $Ga \leqq Gb \leqq 5Ga$.

According to the invention, a beam portion which passes above the magnetic piece is formed in the sound release opening of the housing member, so that it is possible to surely prevent an operator or an object from erroneously contacting with the diaphragm. Therefore, the incidence of defective components of the transducer can be suppressed. In this case, preferably, the opening partitioned by the beam portion is smaller in dimension than an object which may possibly contact with the diaphragm.

Since the peripheral portion of the housing member and the beam portion are integrally formed, the strength of the housing member can be enhanced, so that deformation and a dimensional failure of the housing member can be prevented from occurring.

Even when the beam portion is configured by a thin member, the beam portion can exert sufficient strength. Therefore, the beam portion does not produce a large influence on acoustic performance.

In order to attain high magnetic coupling between the diaphragm and the magnetic core, it is preferable to set the gap Ga between the diaphragm and the magnetic core to be as small as possible. However, a distance of a predetermined value or larger must be ensured so as to prevent the diaphragm from being in contact with the magnetic core when the diaphragm is oscillated. With respect to the gap Gb between the magnetic piece and the beam portion, similarly, a distance of a predetermined value or larger must be ensured so as to prevent the magnetic piece from being in contact with the beam portion when the diaphragm is oscillated. When the gap Gb is set to be excessively large, the whole height of the transducer is increased more than necessary. Consequently, it is preferable to set the gap Gb to be equal to or larger than the gap Ga. In consideration of dimensional and mounting errors of the housing member, and the like, it is preferable to set the gap Gb to be equal to or smaller than five times the gap Ga.

According to the invention, a ratio Se/So is 70% or more, where So is an opening area of the sound release opening, and Se is an effective opening area eliminating an area of the beam portion.

According to the invention, since the ratio Se/So is 70% or more, the influence of the beam portion on the acoustic performance is negligibly small. From the viewpoints of prevention of contact with the diaphragm and enhancement of the housing member, it is preferable to increase the dimensions of the beam portion. However, the opening area is reduced by the beam portion, and hence there is fear that the acoustic performance may be different from that of a full-open-type transducer. By the tests to measure acoustic performance with respect to the size of the beam portion, it has been confirmed that, when Se/So is 70% or more, acoustic performance is not substantially different. Consequently, interchangeability of the electroacoustic transducer of the invention and a full-open-type transducer can be maintained.

DETAILED DESCRIPTION OF THE PRESENT INVENTION

Figure 1:
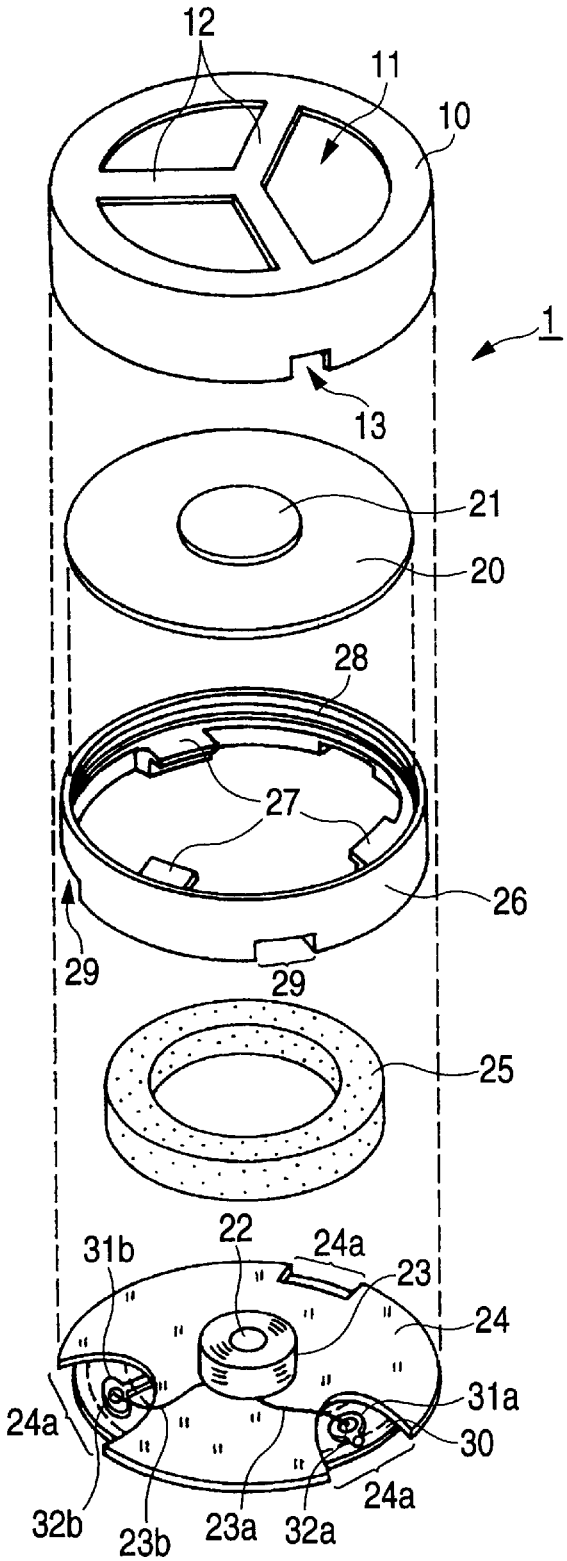
FIG. 1 is an exploded perspective view showing an embodiment of the invention.
Figure 2A:
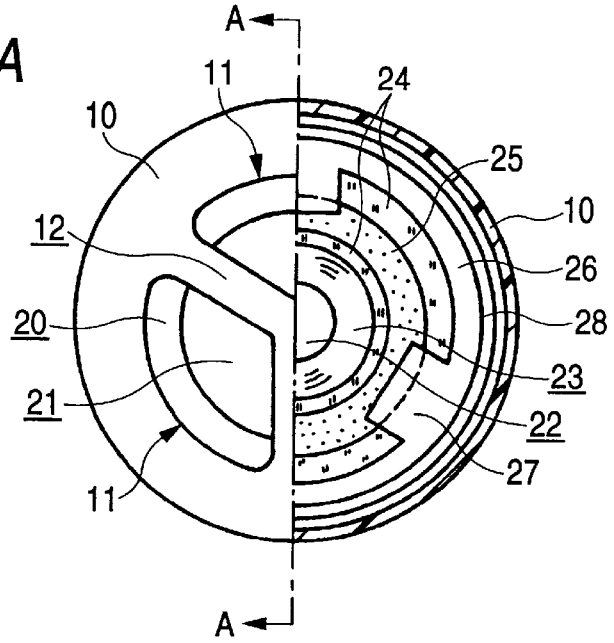
FIG. 2A is a front view (left half) and a section view (right half) as seeing from a sound release hole 11.
Figure 2B:
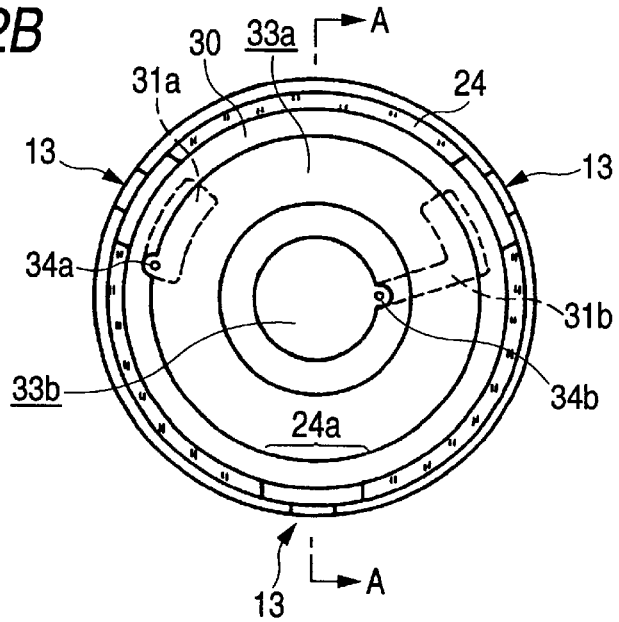
FIG. 2B is a bottom view.
Figure 2C:
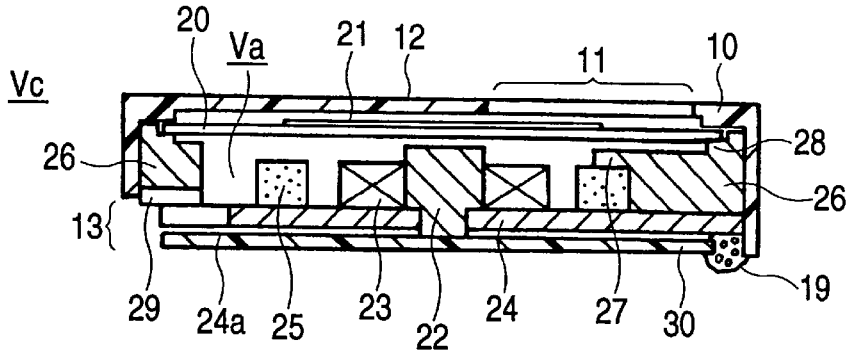
FIG. 2C is an end view taken along the line A—A of FIG. 2A.

FIG. 1 is an exploded perspective view showing an embodiment of the invention, FIG. 2A is a front view (left half) and a section view (right half) as seeing from a sound release hole 11, FIG. 2B is a bottom view, and FIG. 2C is an end view taken along the line A—A of FIG. 2A.

An electroacoustic transducer 1 comprises a housing 10 that accommodates a base 24, a magnetic core 22, a coil 23, a magnet 25, a support ring 26, and a diaphragm 20, and has a flat columnar shape as a whole. For example, the whole of the transducer has approximate dimensions of 12 mm in diameter×3 mm in height.

The base 24 has a disk-like shape in which cutaway portions 24*a* are formed in the circumference. In the embodiment, three cutaway portions 24*a* are formed in the circumference at intervals of 120 deg. A columnar magnetic core 22 upstands from the center of the base 24. A coil 23 is placed around the magnetic core 22. The base 24 and the magnetic core 22 are made of a magnetic material, and may be integrated with each other by crimping or the like so as to be configured as a single pole-piece member.

A disk-like printed circuit board 30 which is slightly smaller than the outer diameter of the base 24 is attached to the bottom face of the base 24. Connecting lands 31*a* and 31*b* to be electrically connected to lead wires 23*a* and 23*b* of the coil 23 by soldering or the like are formed on the upper face of the printed circuit board 30. The connecting lands 31*a* and 31*b* are respectively placed in the cutaway portions 24*a* of the base 24 so that the spaces for connection processing portions 32*a* and 32*b* are ensured by the thickness of the base 24.

This placement of the connection processing portions 32*a* and 32*b* on the side of the inner space enables the transducer to be thinned so that the height in mounting can be reduced.

As shown in FIG. 2B, connecting lands 33*a* and 33*b* for obtaining electrical connection with an external circuit board are concentrically formed on the bottom face of the printed circuit board 30. Through holes 34*a* and 34*b* are formed in parts of the connecting lands 33*a* and 33*b* so as to attain connections between the connecting lands 31*a* and 31*b* on the upper face, and the connecting lands 33*a* and 33*b* on the bottom face.

Returning to FIG. 1, the magnet 25 has an annular shape and is placed on the base 24 so as to be concentric with the magnetic core 22. An annular inner space is ensured between the magnet 25 and the coil 23.

The support ring 26 is made of a non-magnetic material. The outer diameter of the support ring 26 is substantially equal to that of the base 24. The support ring is placed so as to be in contact with the base 24. As shown in FIG. 2A, a plurality of annular steps are formed on the inside of the support ring 26. In the steps, three protrusions 27 are arranged at intervals of 120 deg. so as to protrude inside the support ring 26. The protrusions 27 abut against the upper and outer faces of the magnet 25 to restrict the position of the magnet 25. An annular inner space is ensured between the inner face of the support ring 26 and the magnet 25. The partial formation of the protrusions 27 enables the inner space to be opened.

Communication grooves 29 through which the inner space and the outer space communicate with each other are formed in the bottom face of the support ring 26. Three communication grooves 29 are formed at intervals of 120 deg. so as to respectively correspond to the positions of the cutaway portions 24*a* of the base 24.

As one of the plurality of annular steps, a horizontal supporting step 28 is annually formed above the protrusions 27. The disk-like diaphragm 20 is placed on the supporting step 28, and positioned in place.

The diaphragm 20 is made of a magnetic material, and supported at the peripheral edge portion by the supporting step 28 of the support ring 26, and a constant air gap is ensured between the center of the back face of the diaphragm 20 and the forward end of the magnetic core 22. A disk-like magnetic piece 21 is fixed to the center of the front face of the diaphragm 20 so as to increase the mass of the diaphragm 20, thereby improving the efficiency of oscillating the air.

The housing 10 is made of synthetic resin such as thermoplastic resin, and formed into a cylindrical box-like shape so as to coincide with the outer diameter of the base 24. As shown in FIG. 2C, the housing 10, the base 24, and the printed circuit board 30 are bonded together by a bonding material 19 such as an adhesive agent or a molding resin.

In the top plate of the housing 10, the sound release hole 11 the diameter of which is larger than the magnetic piece 21 is formed so as to be opposed to the diaphragm 20, thereby constituting an open-type electroacoustic transducer. For example, the magnetic piece 21 has a diameter of 6 mm, and the sound release hole 11 has a diameter of about 8 mm. In the sound release hole 11, a beam portion 12 through which the peripheral portions are bridge-coupled to each other is formed integrally with the housing 10 so as to pass over the magnetic piece 21. In the embodiment, an example in which the beam portion is configured by three beams arranged at intervals of 120 deg. is shown. Alternatively, the beam portion may be configured by two beams which are arranged at intervals of 180 deg., four beams which are arranged at intervals of 90 deg., or five or more beams.

When the beam portion 12 is formed as described above, it is possible to prevent contact of the diaphragm 20 from occurring and to reinforce the housing 10. As shown in FIG. 2C, the beam portion 12 is formed in a position where the portion allows the diaphragm 20 to normally oscillate and does not cause the whole height of the transducer to be increased.

In order to enhance the magnetic coupling between the diaphragm 20 and the magnetic core 22, it is preferable to set the gap Ga between the back face of the diaphragm 20 and the forward end of the magnetic core 22 to be as small as possible. However, a distance of a predetermined value or larger must be ensured so as to prevent the diaphragm 20 from being in contact with the magnetic core 22 when the diaphragm is oscillated. With respect to the gap Gb between the surface of the magnetic piece 21 and the inner face of the beam portion 12, similarly, a distance of a predetermined value or larger must be ensured so as to prevent the magnetic piece 21 from being in contact with the beam portion 12 when the diaphragm 20 is oscillated. When the gap Gb is set to be excessively large, the whole height of the transducer is increased more than necessary. Consequently, it is preferable to set the gap Gb to be equal to or larger than the gap Ga. In consideration of dimensional and mounting errors of the housing member 10, and the like, it is preferable to set the gap Gb to be equal to or smaller than five times the gap Ga.

In the configuration of FIG. 1, for example, the gap Ga is set to be about 0.17 mm, and the gap Gb to be about 0.21 mm.

Three cutaway portions 13 are formed at intervals of 120 deg. in a bottom portion of the side face of the housing 10. The positions of the cutaway portions 13 correspond to those of the communication grooves 29 of the support ring 26, and also to those of the cutaway portions 24*a* of the base 24 as shown in FIG. 2B.

When the communication grooves 29, the cutaway portions 24*a*, and the cutaway portions 13 are disposed and the protrusions 27 are intermittently arranged as described above, paths through which the back space Va of the diaphragm 20 and the external space Vc communicate with each other can be formed.

Next, the operation will be described. The magnet 25 is magnetized in the thickness direction. When the bottom face of the magnet 25 is magnetized to the N-pole and the upper face to the S-pole, for example, lines of magnetic force emerging from the bottom face of the magnet 25 pass through a route of the peripheral portion of the base 24→the center portion of the base 24→the magnetic core 22→the center portion of the diaphragm 20→the peripheral portion of the diaphragm 20→the upper face of the magnet 25, to constitute a magnetic circuit which is closed as a whole. The magnet 25 has a function of supplying a static magnetic field to the magnetic circuit. The diaphragm 20 is stably supported in a state where the diaphragm is attracted toward the magnetic core 22 and the magnet 25 by the static magnetic field.

When an electric oscillating signal is supplied from the circuit board to the coil 23 wound around the magnetic core 22 via the connecting lands 33*a* and 33*b*, the through holes 34*a* and 34*b*, the connecting lands 31*a* and 31*b*, and the lead wires 23*a* and 23*b*, the coil supplies an oscillating magnetic field to the magnetic circuit. Then, the oscillating magnetic field is superimposed on the static magnetic field, whereby the diaphragm 20 is oscillated. As a result, the air on the side of the front face of the diaphragm 20, and that on the side of the back face are oscillated.

The sound which is generated on the side of the front face of the diaphragm 20 is emitted to the outside through the sound release hole 11. The sound which is generated on the side of the back face of the diaphragm 20 is opposite in phase to the sound on the side of the front face, and hence interference with the sound on the side of the front face must be suppressed as far as possible. To comply with this, the sound on the side of the back face of the diaphragm 20 is emitted to the outside via the annular inner space, the spaces between the protrusions 27, the gap between the support ring 26 and the magnet 25, the communication grooves 29, the cutaway portions 24*a*, and the cutaway portions 13 of the housing 10.

When the communication paths for a back sound are disposed in this way, the air damping effect in the back space of the diaphragm 20 can be efficiently lowered, so that it is possible to realize an electroacoustic transducer which is small in size and produces a high sound pressure.

The formation of the cutaway portions 13 in the side wall of the housing 10 prevents the back face paths from being closed even in a state where the bottom face of the transducer is closely mounted on a circuit board. Therefore, the mounting height can be reduced.

Figure 3:
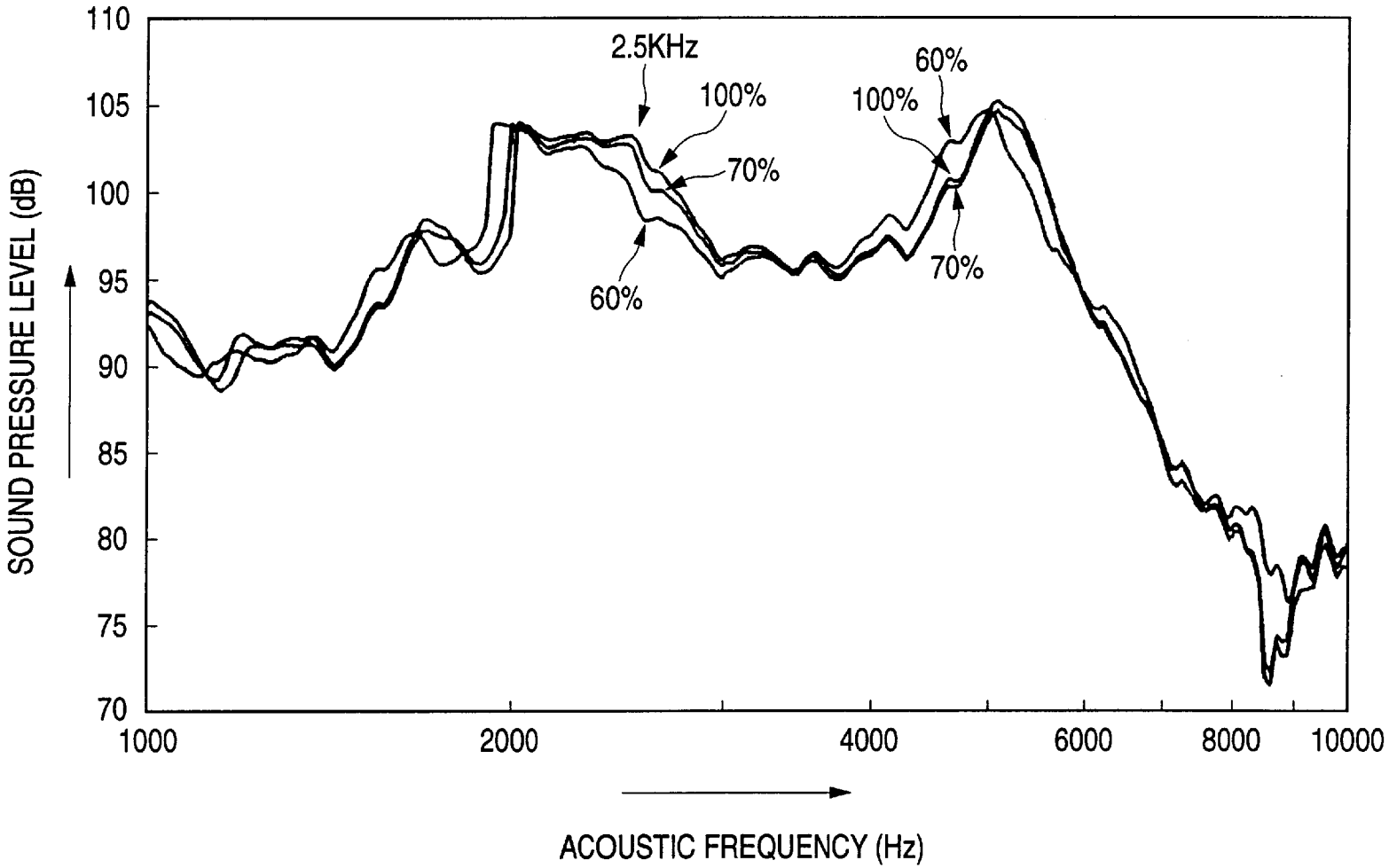
FIG. 3 is a graph exemplarily showing the frequency characteristics of an electroacoustic transducer 1.
Figure 4:
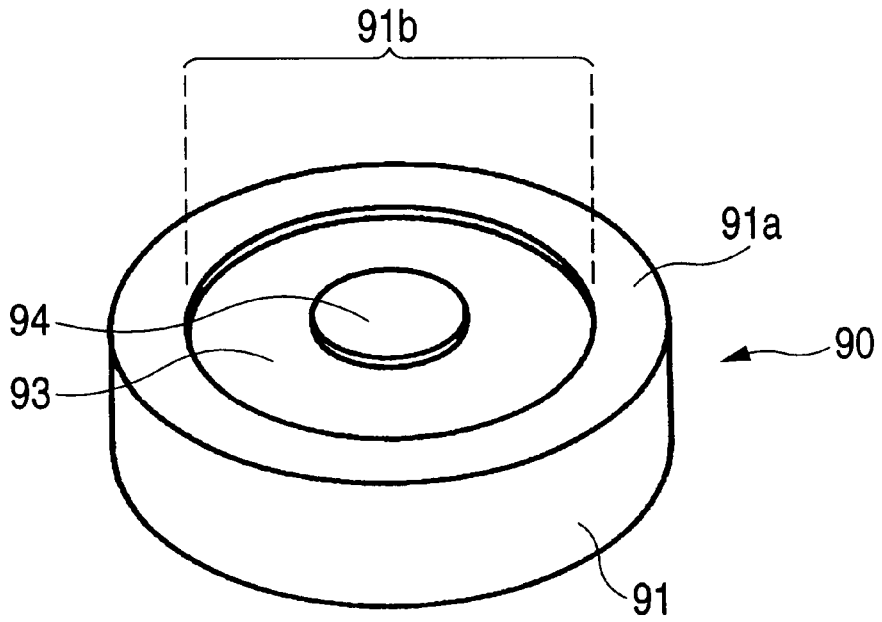
FIG. 4 is a perspective view showing an example of an electroacoustic transducer of the conventional art.

FIG. 3 is a graph exemplarily showing the frequency characteristics of the electroacoustic transducer 1. The abscissa indicates the acoustic frequency (Hz), and the ordinate indicates the sound pressure level (dB). The curves show a) the case where the transducer is of the full open type (the opening area So=100%) in which the beam portion 12 is not formed, b) the case where, as shown in FIG. 1, the beam portion 12 configured by three beams is formed and the ratio Se/So is 70%, where Se is the effective opening area eliminating the area of the beam portion, and c) the case where the area of the beam portion 12 is increased so that the ratio Se/So is 60%, respectively.

First, the vicinity of 5 kHz is observed. The position of the peak indicates the resonance frequency fv. It will be seen that the resonance frequency fv in the case of 60% is slightly lower than the resonance frequencies in the cases of 100% and 70%. The driving frequency of an electroacoustic transducer is set to be in the range of 2 to 3 kHz which is about a half of the resonance frequency fv. Therefore, this range is then observed. It will be seen that the frequency characteristics in the case of 60% are largely changed as compared with those in the cases of 100% and 70%. The sound pressure level of 60% is lowered as a whole, and in contrast the levels in the cases of 100% and 70% are less changed. In the vicinity of 2.5 kHz, particularly, the sound pressure level in the case of 60% is lowered by about 3 dB.

From the above, it will be seen that the beam portion 12 is preferably formed so that Se/So is 70% or more, the influence of the beam portion 12 on the acoustic performance can be made small, and interchangeability with a full-open-type transducer can be maintained.

As described above in detail, according to the invention, since the beam portion which passes above the magnetic piece is formed in the sound release opening of the housing member, it is possible to surely prevent an operator or an object from erroneously contacting with the diaphragm. Therefore, the incidence of defective components of the transducer can be suppressed.

Since the peripheral portion of the housing member and the beam portion are integrally formed, the strength of the housing member can be enhanced, so that deformation and a dimensional failure of the housing member can be prevented from occurring.

The gap Ga between the diaphragm and the magnetic core, and the gap Gb between the magnetic piece and the beam portion satisfy relationships of $Ga \leqq Gb \leqq 5Ga$, whereby the transducer can be thinned without impeding oscillation of the diaphragm.

Since the ratio Se/So, the ratio of the effective opening area to entire opening area of the sound release opening, is 70% or more, the influence of the beam portion on the acoustic performance is negligibly small.

What is claimed is:

1. An electroacoustic transducer comprising:

a diaphragm made of a magnetic material having a magnetic piece fixed onto the center thereof;

a magnetic core disposed with a gap Ga from the diaphragm;

an electromagnetic coil for supplying an oscillating magnetic field to the magnetic core; and a housing member accommodating the diaphragm, the magnetic core, and the electromagnetic coil, and defining a sound release opening in a top surface thereof opposed to the diaphragm, the sound release opening being larger than the magnetic piece, wherein a beam portion is integrally formed with the housing member, and extends from a peripheral portion of the sound release opening to another peripheral portion thereof;

the beam portion passes above the magnetic piece with a gap Gb being defined between the magnetic piece and the beam portion; and the gap Ga and the gap Gb satisfy a relationship of $Ga \leqq Gb \leqq 5Ga$.

2. The electroacoustic transducer according to claim 1, wherein a ratio Se/So is 70% or more, where So is an opening area of the sound release opening, and Se is an effective opening area eliminating an area of the beam portion.

3. The electroacoustic transducer according to claim 1, further comprising a base mounting the magnetic core thereon.

4. The electroacoustic transducer according to claim 3, further comprising a printed circuit board disposed on the base, wherein the base has a plurality of cutaway portions apart from each other at given intervals; and the coil is placed around the magnetic core electrically connected to the circuit board through the plurality of cutaway portions.

* * * * *